United States Patent [19]

de Jager

[11] Patent Number: 5,067,527

[45] Date of Patent: Nov. 26, 1991

[54] ADJUSTMENT OF WEFT YARN STRETCH IN A SHED OF AN AIR JET LOOM

[75] Inventor: Godert de Jager, Uster, Switzerland

[73] Assignee: Sulzer Brothers Limited, Winterthur, Switzerland

[21] Appl. No.: 559,171

[22] Filed: Jul. 27, 1990

[30] Foreign Application Priority Data

Sep. 1, 1989 [CH] Switzerland ..... 3183/89

[51] Int. Cl.[5] ..... D03D 47/30

[52] U.S. Cl. ..... 139/435.2; 139/370.2; 139/435.5; 139/452

[58] Field of Search ..... 139/370.2, 452, 435.1, 139/435.2, 435.5

[56] References Cited

U.S. PATENT DOCUMENTS 4,673,004 6/1987 Rosseel et al. .
4,827,990 5/1989 Takegawa ..... 139/435.2
4,877,064 10/1989 Pezzoli ..... 139/452 X
4,967,806 11/1990 Imamura et al. ..... 139/452 X

FOREIGN PATENT DOCUMENTS 0263445 4/1988 European Pat. Off. .
0290975 11/1988 European Pat. Off. .
2567926 1/1986 France .

*Primary Examiner*—Andrew M. Falik
*Attorney, Agent, or Firm*—Kenyon & Kenyon

[57] ABSTRACT

A method for adjusting weft yarn stretching in an ordinary or traversing shed and for adjusting the air consumption of relay nozzles forming a travelling zone in the shed of an air jet loom having one or more yarn feed systems. The weft yarns are picked from a weft preparation system by main nozzles with the assistance of relay nozzles. The arrival of the weft yarns is monitored by a weft stop motion, the weft yarns being stopped in their movement by stopper elements disposed before the shed and a facility is provided for controlling the pressure and timing of the main nozzles and the relay nozzles. By the measurement and statistical evaluation of a time difference $\Delta t_1$ between the arrival of the weft yarn at a weft stop motion at the end of the shed and the actual stop shock when the weft yarn is stopped by the stopper elements before the shed, a signal representative of yarn deflection found which is of use for optimizing and controlling the adjustment of the relay nozzles.

20 Claims, 4 Drawing Sheets

ADJUSTMENT OF WEFT YARN STRETCH IN A SHED OF AN AIR JET LOOM

Figure 1:
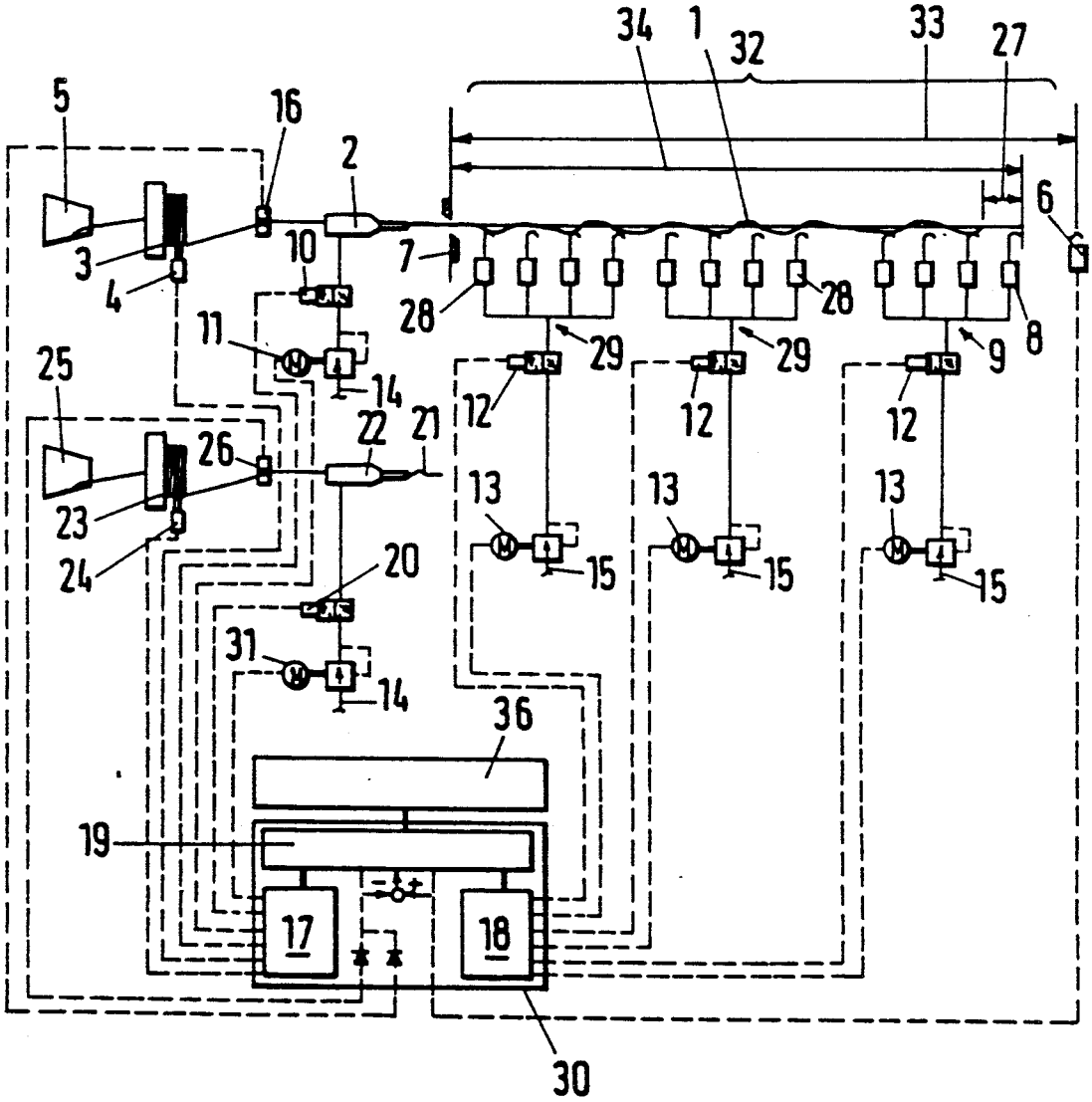

This invention relates to a method and apparatus for adjusting weft yarn stretching in a shed of an air jet loom.

As is known, air jet looms have been provided with one or more weft yarn feed systems wherein a weft yarn is picked from a weft preparation system into a shed of warp yarns by a main picking nozzle assisted by groups of relay nozzle disposed across the shed. In addition, various types of controls have been used to monitor and control the picking of weft threads in such looms For example, in one known control the arrival of a weft yarn at the end of the shed has been monitored by a shed-end stop motion in order to determine if the weft yarn arrives at a predetermined time or phase of a loom cycle. It has also been known to use stopper elements upstream of the shed, for example, on a weft storage drum or the like to stop a weft yarn. Various types of pressure and timing controls have also been known which employ timing valves and pressure controlling valves in order to trigger the main nozzles as well as separate timing and pressure control valves to trigger the relay nozzles.

By way of example, U.S Pat. No. 4,673,004 describes an adjustable control of a weft in a weaving loom wherein a control unit for releasing a predetermined length of weft thread is controlled with respect to control time and duration time in response to measurements made by a weft stop motion and sensors which are distributed over the loom width in order to signal the passing of the head of the weft thread.

European patent application 0263445 describes the regulation of a plurality of groups of relay nozzles in an air jet loom in dependence on the running characteristics of a weft yarn. In this respect, the running characteristics of the weft yarn are determined on the basis of a phase angle of a main shaft of the loom and the relation between a starting position corresponding to the main nozzle and the arriving position. When a difference in the characteristic is detected, the total jet periods for the relay nozzles is adjusted.

European patent application 0290975 describes an automatic picking control method wherein a number of jetting patterns for the relay nozzles are programmed in a memory and a jetting pattern selected for a particular running condition in response to the reading of a jetting pattern of a picked yarn. As described, when the running characteristics of a picked yarn vary, the jetting pattern of the relay nozzle groups is regulated automatically to an optimum jetting pattern according to the variation of the actual running characteristics of the picked weft yarn.

In summary, a variety of measuring facilities for monitoring yarn movement and recording arrival of a weft yarn at the end of a shed as well as associated means for controlling the blowing times and blowing pressures of relay nozzles have been known. However, despite the controls which have been known, the relay nozzles are heavy consumers of compressed air even for a time-limited travelling zone usually provided in order to save compressed air.

As is known, compressed air consumption is, of itself, a substantial factor in the cost of operating air jet looms and particularly the relay nozzles. Hence, any technique for reducing the working pressures and the compressed air consumption of such relay nozzles is of economic importance.

Accordingly, it is an object of the invention to insure a very low consumption of compressed air by relay nozzles in an air jet loom without risk of additional loom down times.

It is another object to the invention to reduce the air consumption by relay nozzles in an air jet loom.

It is another object to the invention to reduce the cost of operating air jet looms.

It is another object to the invention to reduce air consumption during the setting-up of an air jet loom, for example during article changes.

Briefly, the invention provides a method of adjusting weft yarn stretching in a shed of an air jet loom having at least one main blowing nozzle and a plurality of groups of relay nozzles disposed across a shed.

In accordance with the method, the arrival of a picked weft yarn is detected at a shed-end weft stop motion and a first signal is emitted in response thereto. In addition, a stop shock in the picked weft is detected in a shed-entry stop motion with a second signal being emitted in response thereto. The time difference between these two signals is then measured and used as a parameter for the stretching of the weft yarn in the shed and as a parameter for controlling at least the relay nozzles in the picking of a weft yarn in the shed.

In accordance with the invention, the time difference between the response of the weft stop motion at the end of the shed and the stop shock as detected by the stop motion before shed entry during the picking of a weft yarn provides a control criterion for triggering the relay nozzles during continuous weaving so that compressed air requirements are always limited to what is strictly necessary. This, in turn, greatly reduces the air consumption by the relay nozzles without risk during the setting up of a loom, for example, during article changes.

What can be regarded as an advantage of the invention is that a representative measurable variable for stretching of the weft yarn in the shed and for the effect of the relay nozzles has been found which enables the compressed air consumption of the relay nozzles to be minimized towards a predetermined yarn stretching.

In accordance with the invention, an air jet loom is provided with one or more main blowing nozzles for the picking of weft yarns into a shed of warp yarns, a plurality of groups of relay nozzles disposed across the shed for blowing a weft yarn along in the shed, at least one pressure valve for controlling the blowing pressure of the relay nozzles and a plurality of timing valves each of which is connected with a respective group of relay nozzles for controlling the blowing time of the respective group of relay nozzles.

In addition, a shed-end stop motion is provided to detect the arrival of a picked weft yarn at the end of the shed and for emitting a signal in response thereto and a shed-entry stop motion is provided to detect a stop shock in the weft yarn and for emitting a second signal in response thereto. Further, a loom control system is connected to each of the stop motions to receive the signals as well as to the valves for controlling the subsequent operation of the valves in dependence on a time difference in the signals received from the stop motions for a given pick. In this respect, the loom control system includes a computer for evaluating the signals from the stop motions and a controller group connected to the valves to produce a travelling zone in the groups of relay nozzles. The computer is connected to the controller to program the operation of the valves.

Figure 2:
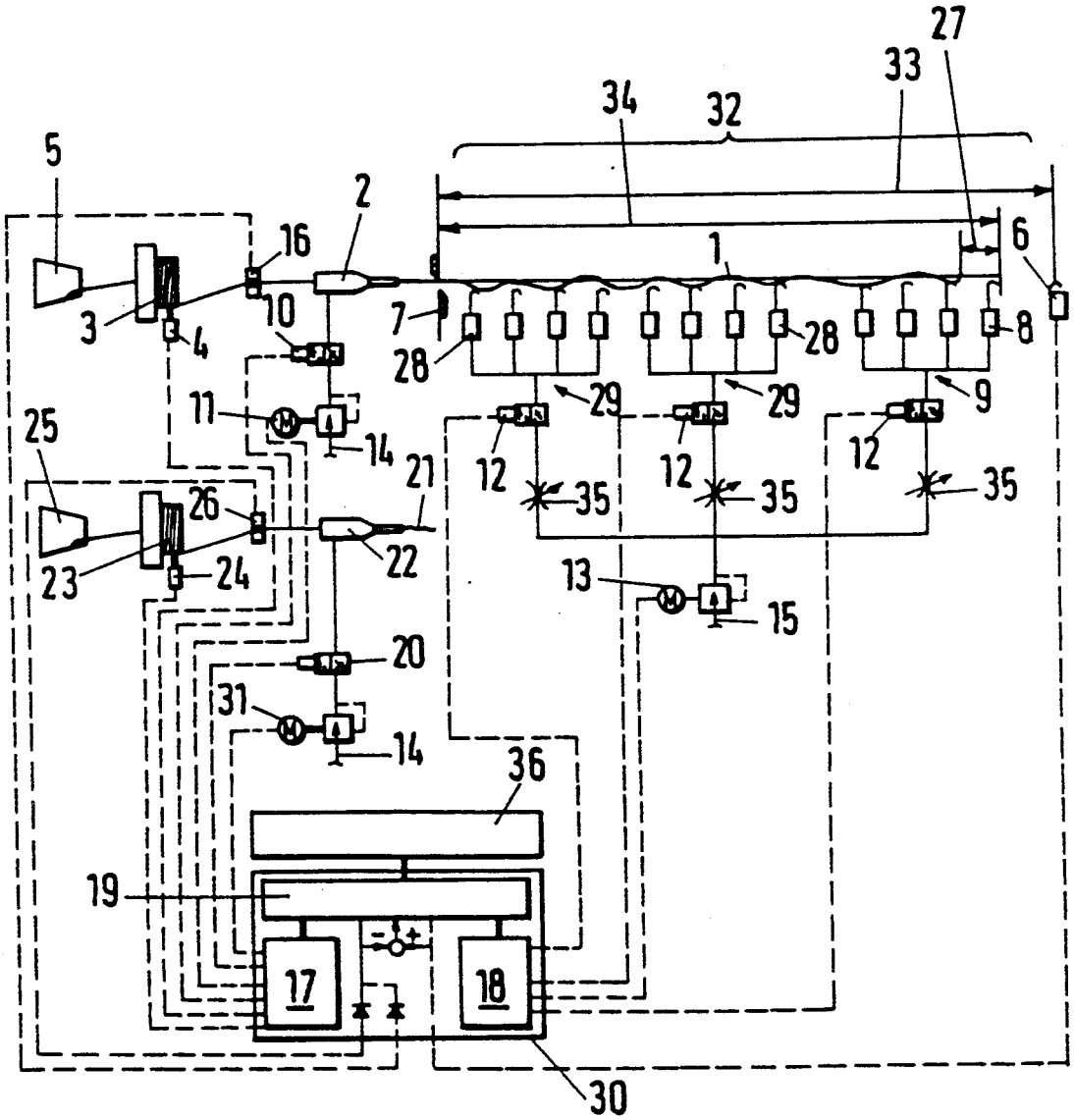
Figure 3:
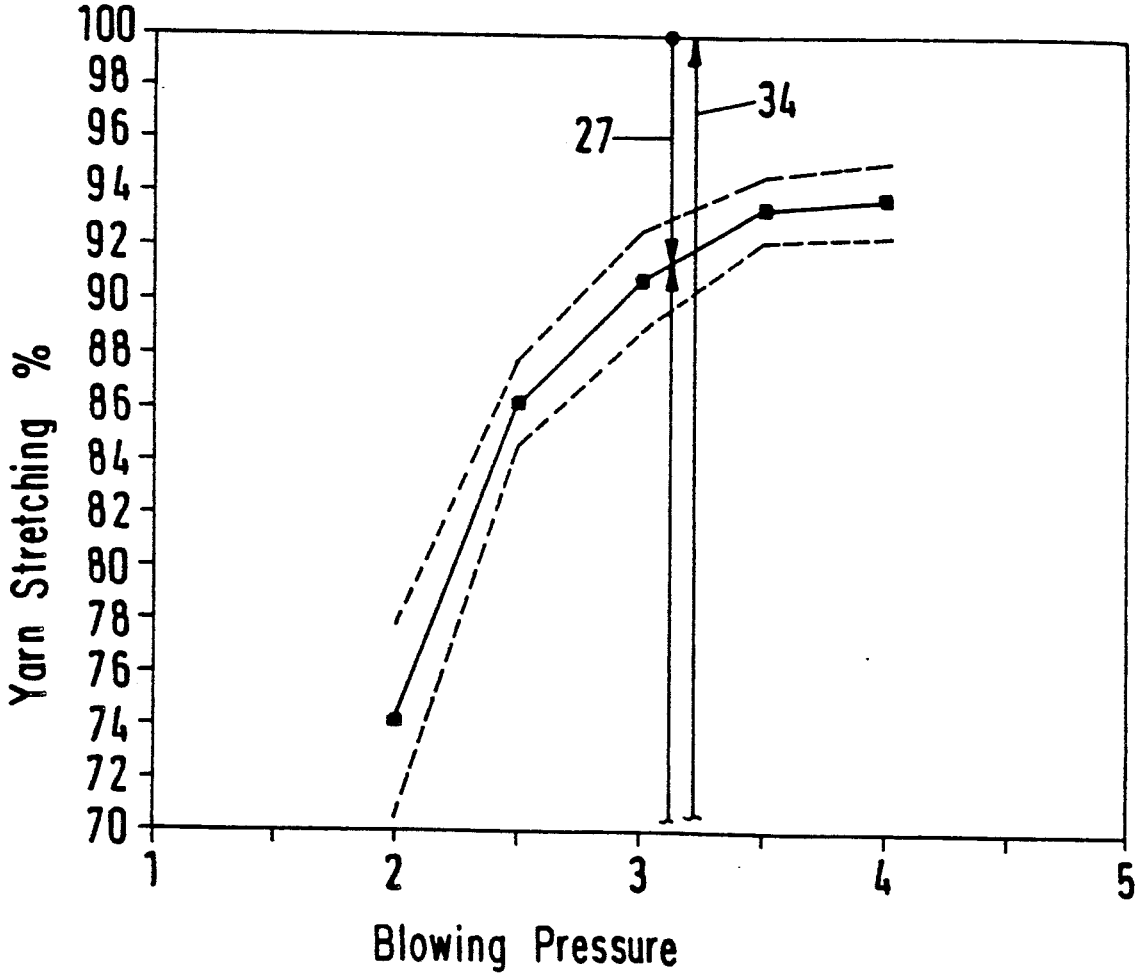
Figure 4:
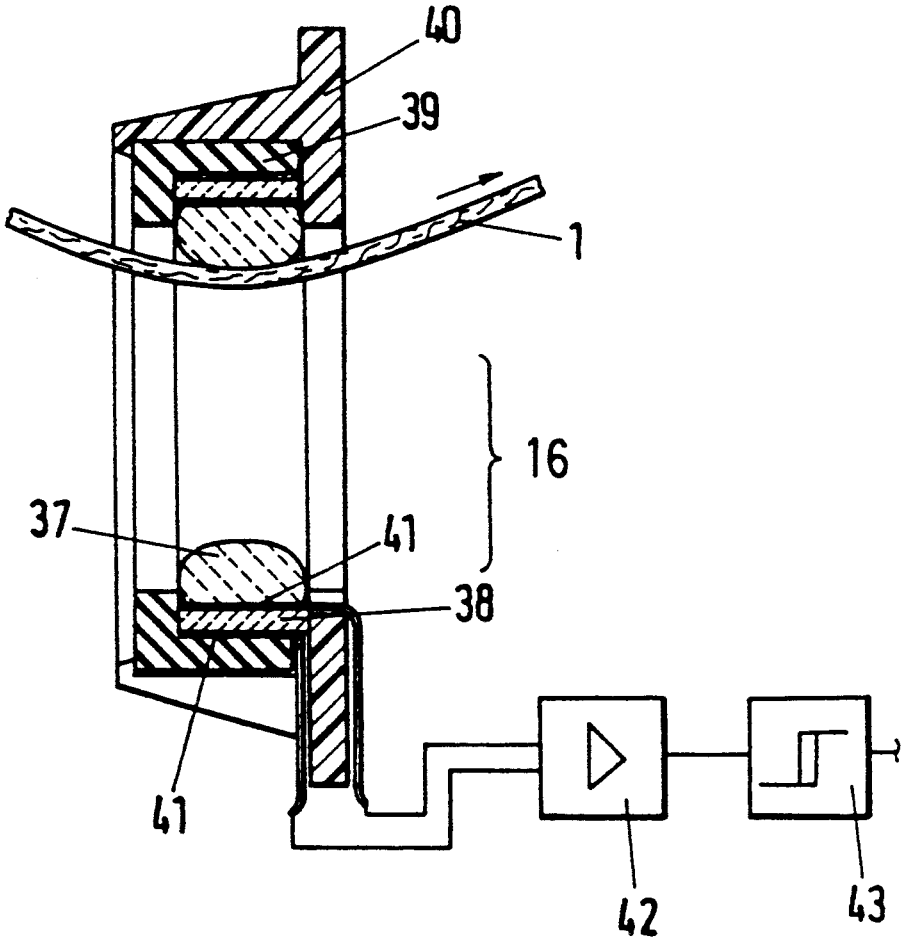

These and other objects and advantages of the invention will become more apparent from the following detailed description taken in conjunction with the accompanying drawing wherein:

FIG. 1 schematically illustrates an air jet loom constructed in accordance with the invention;

FIG. 2 schematically illustrates an air jet loom having a modified pressure valve arrangement in accordance with the invention;

FIG. 3 graphically illustrates a weft yarn stretching plotted against blowing pressure of the relay nozzles of the loom; and FIG. 4 illustrates an enlarged view of a shed-entry stop motion for detecting a stop shock in a weft yarn end using piezoelectric elements.

Referring to FIG. 1, the air jet loom is of generally known construction, for example having two changing yarn feed systems for the picking of weft yarns 1, 21 into a shed 32 of warp yarns. As indicated, the weft yarns 1, 21 of predetermined length are drawn off accumulators 3, 23 by main picking nozzles 2, 22 and picked into the shed 32 with the assistance of groups of relay nozzles 8, 28 which are disposed across the shed 32 for blowing the yarn 1, 21 along in the shed. The arrival of the weft yarns 1, 21 at the end of the shed 32 is monitored by a weft yarn stop motion 6 and the weft yarns are stopped in their movement by stopper elements 4, 24 disposed before the shed 32. The, stopper elements 4, 24 stop the yarn movement after an afore metered length of yarn has been picked into the shed 32 and the abrupt retardation produces a so-called stop shock in the weft yarn.

Supply bobbins 5, 25 feed in weft yarns which after picking are severed by shears 7, the place of severance forming a reference for the next pick from the same main nozzle 2, 22. As referred to this reference, the head or tip of the weft yarn in the next pick must cover at least the distance 33 to the stop motion 6 at the other end of the shed 32 in order to produce an expected arrival signal. This arrival signal is used in a loom control system 30 to confirm the arrival of the weft yarn for continuation of a normal weaving cycle and also to produce, by comparison between a reference arrival time and the actual arrival time, signals for correcting the adjustment of the main nozzles 2, 22. These signals act by way of a pressure-controlling valve 11, 31 to vary the blowing pressure and by way of a timing valve 10, 20 to vary the blowing time of the main nozzles 2, 22.

The loom control system 30 includes a weft preparation control and a controller group 17 which acts on the stopper elements 4, 24 as well as the pressure-controlling valves 11, 31 and timing valves 10, 20 of the main nozzles 2, 22. A controller group 18 also acts on the relay nozzles 8, 28 in order to produce a travelling zone in the relay nozzle groups 9, 29 by means of timing valves 12 and to adjust the relay nozzle pressure by means of the pressure-controlling valves 13. Air lines 14, 15 extend to a compressed air supply.

As shown, the shed-end stop motion 6 emits a signal in response to the detection of the arrival of a picked weft and delivers the signal over a line to an internal computer 19 in the loom control system 30. Likewise, weft-entry stop motion 16 emits a signal in response to the detection of a stop shock which is delivered via a line to the internal computer 19. The corresponding shed-entry stop motion 26 for the other weft yarn 21 also delivers a similar signal to the internal computer 19 when operational. Instead of using a stop motion 16, 26 measuring the stop shock the emptying of the accumulator from a predetermined length of weft yarn can also be monitored by other sensors giving signal for an empty accumulator.

The internal computer 19 is connected to the controller group 18 so as to operate the timing valves 12 and pressure-controlling valves 13 in dependence on a time difference in the signals received from the stop motions 6 and from the stop motions 16, 26. To this end, during the picking of a weft yarn 1, 21, the time difference $\Delta t_1$ between the response of the weft stop motion 6 at the end of the shed 32 and the stop shock, as detected by the stop motion 16, 26 is measured and used as a parameter for the stretching of the weft yarn 1, 21 in the shed 32 and as a parameter for the effect of the relay nozzles 8, 28 in the control system 30 of the loom.

In accordance with the arrangement shown in FIG. 1, the theoretical assumption will first be made that, in relation to the distance 33 between the stop motion 6 and the shears 7, the weft yarn 1, 21 is fed in with an excess length such that despite a shortening 27, the weft yarn tip reaches the stop motion 6 before the stopper elements 4, 24 act on the weft yarn. The weft yarn will hardly reach its ideal stretching 34 during picking in the shed 32 but will always arrive at the stop motion 6 with the delay of a weft yarn shortening 27, the same depending mainly upon the deflecting and stretching effect of the relay nozzles 8, 28. The time for $\Delta t_1$ starts to run with the response of the stop motion 6. The stopper elements 4, 24 stop the weft yarn at a predetermined length and the yarn elongates in accordance with its elasticity and shortening 27 up to a maximum stretch. A so-called stop shock—i.e., a tension peak measured in the weft yarn before the shed is detected by means of stop motion 16, 26 in time, preferably in the rising flank of the tension, and terminates the time $\Delta t_1$.

In practice, an excess length of weft yarn cannot be assumed nor can a stop shock with unsatisfactory stretching and non-actuation of the stop motion 6 be excluded. Also, the position of the stop motion 6 is probably predetermined. Consequently, referred to a common starting time—i.e., as triggered by the cycle control—a time measurement is made up to the response of the stop motion 6 and a time measurement is made up to the detection of the stop shock in the stop motion 16, 26 and a time difference $\Delta t_1$) is formed. Irrespective of sign, the value of the time difference $\Delta t_1$) must be small if the shortening 27 is to be small. Since the stop shock dynamics, which are affected by the mass and elasticity of a weft yarn, vary little for a particular loom arrangement and the accuracy of metering a predetermined weft yarn length and the accuracy of response of a stop motion 6 are high, they are of secondary importance as disturbance variables. Consequently, the variations of the time difference $\Delta t_1$ correlate very well with variation of weft yarn shortening 27 due to deflection over the whole length of the shed.

A very wide variety of stop motions 16, 26 are available, usually in the form of a measurement of force or distance associated with yarn deflection. However, optical stop motions are another possibility; when activated they measure a yarn displacement in the event of the stop shock not acting in the direction of the other accelerating forces acting on the yarn.

FIG. 4 shows a piezoelectric stop motion 16, 26 in which the weft yarn 1, 21 is deflected by means of a ceramic loop or ring or the like borne in a casing 40 with the interposition of a sensor foil 38 covered by a piezo film and of a rubber-like holder 39. The foil 38 has electrical conductors 41 on both sides from which signals are tapped off and further processed by way of a charge amplifier 42 and a Schmitt trigger 43 in order to detect the tension in the deflected yarn.

FIG. 3 graphically illustrates a laboratory examination of relay nozzles of a loom. The graph shows the percentage stretching of weft yarns and their spread plotted against the common blowing pressure of the relay nozzles at a constant blowing pressure of the main nozzle as the average value over a predetermined number of picks. The example shows that for relay nozzle pressures below 3.5 bar, there is a significantly increasing deflection of the weft yarn i.e., a significant impairment of yarn stretching which is scarcely adequate for production purposes. Similar curves are found for weft yarn stretching plotted against relay nozzle blowing time, a significant shortening of yarn stretching occurring as blowing time decreases.

It is sufficient to evaluate variations in the measurements of the difference time $\Delta t_1$ in order to discover the effect of blowing pressure and blowing times on weft yarn deflection i.e., the percentage shortening of the weft yarn, in the same way as in FIG. 3. To discover the permissible limits, the approximation proceeds from a reliable functioning range of high blowing pressure and long blowing time. After a predetermined number of picks, preferable between 20 and 2000 picks, the values $\Delta t_1$ for a quality criterion are statistically evaluated stepwise and the criterion permits a stepwise reduction of blowing pressure or blowing time until an unacceptable value is reached corresponding, for example, to an unacceptable gradient of the averaged yarn stretching for FIG. 3. Since the complete detection of the time difference $\Delta t_1$ contains disturbance variables and since the quality criterion is formed statistically over a limited number of picks, the quality criterion is very likely to be impaired at any time without visible alteration of the margin conditions. Thus, the quality criterion provides, with each step in which an impairment is found, a defined amount of increase of the particular variable—blowing pressure or blowing time—concerned.

The principle described of approaching a limit by means of a parameter from a safe zone as far as an impairment and for moving back by a safety factor until there is no impairment can be carried into effect on the basis of either manual or semiautomatic or fully automatic fine adjustment of relay nozzle parameters or on the basis of continuous set-value adjustment or control of one relay nozzle parameter. Clearly, this kind of parameter adjustment is a form of optimization, compressed air consumption being only as much as is statistically necessary, there being a reduction of from 20 to 30% in the air consumption of relay nozzles from previous values.

For fine adjustment—while the loom is producing—the blowing pressure and blowing time are increased to a safe zone and the signal $\Delta t_1$ is statistically evaluated stepwise over a predetermined number of picks to obtain a quality criterion. Initially, the blowing time remains constant and the blowing pressure of whichever is the last relay nozzle group 9 as considered in the direction of yarn movement is varied stepwise so that, in the meantime, at least one evaluation is made, then reduced by a predetermined amount until the yarn stretching detected on the basis of the quality criterion is found to be too small. Thereafter, blowing pressure is increased by a predetermined amount per evaluation step until yarn stretching is found to be satisfactory. Next, the blowing pressure of whichever is the penultimate relay nozzle group, as considered in the direction of yarn movement, is reduced stepwise until yarn stretching is too small, then increased stepwise until yarn stretching is satisfactory. The other nozzle groups 29 which are disposed oppositely to the direction of yarn movement before the penultimate relay nozzle group 29 have their blowing pressure adjusted consecutively in the same way by means of the associated pressure-controlling valves 13, 35. The entire operation can be iterative, the further approach to the limit and the correction of the adjustment for all the nozzle groups being repeated against the direction of yarn movement and consecutively beginning with the final group 9. The pressure of the relay nozzle groups 9, 29 can also be adjusted by means of adjustable throttle valves 35.

Adjustment of the blowing time of the relay nozzle groups 9, 29 then proceeds in a manner similar to the pressure adjustment. Within a predetermined time pattern for the start of blowing time of the discrete nozzle groups and starting with the group 9 which is last as considered in the direction of yarn movement, the duration of blowing time is decreased stepwise—so that at least one evaluation can be made between the steps—until the yarn stretching detected on the basis of a quality criterion is found to be too small. Thereafter, the blowing time is increased by a predetermined amount per evaluation step until yarn stretching is found to be satisfactory. Thereafter, the other nozzle groups 29 which are disposed oppositely to the direction of yarn movement before the final nozzle group 9 have their blowing time adjusted consecutively and in the same way by means of the associated timing valves 12. The complete operation can be iterative, the further approach to the limit and the correction of the adjustment of blowing time for all the nozzle groups being repeated consecutively against the direction of yarn movement and starting with the final relay nozzle group 9.

A fine adjustment is required, for example, for article changes or at long time intervals. Because of the quantity of data to be evaluated, an external computer 36 is connected up temporarily to boost the internal computer 19 of the loom control system 30. The complete adjustment operation proceeds fully automatically, a program being stored for the time evaluation $\Delta t_1$, with the pressure valves 13, 35 for the blowing pressure and timing valves 12 for the duration of blowing time being triggered by way of the loom control system 30. Semiautomatic performance is possible, the blowing pressure being balanced manually by way of the pressure-adjusting valves 35 and/or the required duration of blowing time being corrected and acknowledged manually before the evaluation continues in a computer.

It has been found that the adjustment of blowing time duration for yarn stretching and optimized air consumption is satisfactorily reproducible and not easily disturbed. Thus, secured empirical values can be fed in as constants for a particular article. Also, after a fine adjustment has been made, the blowing pressure can be adjusted jointly for all the relay nozzle groups by an identical amount $\Delta_p$ in order to optimize yarn stretching Advantageously, therefore, the blowing pressures of the relay nozzle groups are balanced during the fine ad]ustment and the blowing pressure of the relay nozzle groups 9, 29 is used, by way of a common pressure-controlling valve 13, and as shown in FIG. 2 wherein like reference characters indicate like parts as above, as a standing controlled condition for optimizing yarn stretching and air consumption during weaving. Over a predetermined number of picks, the blowing pressure is reduced by a small step $\Delta_p$ in a program loop provided that the quality criterion for yarn stretching was complied with in the previous step, the blowing pressure being increased by a small step $\Delta_p$ in the event of non-compliance with the quality criterion. Adapting the steps $\Delta_p$ to the number of picks examined per step and damping action by control means obviates control instability.

The gradient of the average time difference $\Delta t_1$ over a predetermined number of picks has been found to be very predictable as a quality criterion. When weft changers are used, the systematic variations for yarn stretching are better related when the standard variation S(t) over the same number of picks is included in the quality criterion, so that a general form for the quality criterion is given by $$a[S(\Delta t_1)]\alpha + b(\overline{\Delta t_1})\beta$$

a and b denoting amplification factors and [$\alpha$], [$\beta$] denoting exponents or general mathematical operators. For example ($\overline{\Delta t_1}$) can correspond to the differential of $\Delta t_1$.

Other advantage provided by controlling the blowing pressure of the relay nozzles in this way are that control of the blowing pressure and blowing time of the main picking nozzle is much less ambiguous when the weft yarns experience a definite stretching during picking.

Also, the stretching forces and the picking effect of the relay nozzles can be used deliberately to increase the picking rate if the blowing pressure of the main picking nozzle has an upper limit, for example, because of fraying-out of the weft yarn tip. In this case, the quality criterion is expanded for this purpose by a term $-c(\overline{\Delta t_2})^{\gamma}$ which contains in attenuated form the average $\Delta t_2$ of the time difference $\Delta t_2$ between the actual arrival at the stop motion 6 and the reference arrival of the weft yarn, corresponding, for example, to a particular angular position of the loom main shaft; c denotes the amplification factor and $\gamma$ denotes an exponent or mathematical operator. The advantage of such a control is that when the limit for the main nozzle blowing pressure has been reached, the relay nozzles increase the blowing pressure in very small steps without any kind of changeover for as long as the movement time of the weft yarn is too long.

The method described herein for determining yarn stretching can be used basically for examining and controlling all the parameters which divert the weft yarn away from its ideal stretching and shorten the yarn between the stopper element 4, 24 and the stop motion 6. The method is of use in air jet looms in which one or more weft preparation systems is or are associated with a shed and in air jet looms having a multiple shed with which one or more weft preparation systems is or are associated.

The invention thus provides a control for the relay nozzles of an air jet loom which reduces the amount of compressed air required for the picking of a weft yarn through a shed. Further, the invention provides a relatively simple means for controlling the air pressure and the blowing time of the relay nozzles in an air jet loom.

What is claimed is:

1. A method of adjusting weft yarn stretching in a shed of an air jet loom having at least one main blowing nozzle and a plurality of groups of relay nozzles disposed across a shed, said method comprising the steps of detecting the arrival of a picked weft yarn at a first weft stop motion at an end of the shed and emitting a first signal in response thereto;

detecting a stop shock in the picked weft in a second stop motion upstream of the shed or a similar signal that the accumulated predetermined length of weft has been drawn off the accumulator and emitting a second signal in response thereto; and measuring the time difference between said signals and using said measured time difference as a parameter for the stretching of the weft yarn in the shed and as a parameter for controlling at least the relay nozzles in the picking of a weft yarn in the shed.

2. A method as set forth in claim 1 wherein the relay nozzles are disposed in groups along the shed and which further comprises the steps of raising the duration of blowing time and blowing pressure of the relay nozzle groups into a safe zone in response to said parameter;

storing the values of subsequently generated time differences over a predetermined number of picks; and statistically evaluating the stored signals to form characteristic parameters for controlling the relay nozzle groups.

3. A method as set forth in claim 2 which further comprises the steps of decreasing the blowing pressure of the last relay nozzle group relative to the direction of weft yarn travel in a stepwise manner after a predetermined number of picks until a per step statistical evaluation shows a significant increase in said time difference; and increasing the blowing pressure of the last relay nozzle group by a safety factor in response to a significant increase in said time difference over a previous time difference until said increase disappears.

4. A method as set forth in claim 3 which further comprises the steps of adjusting the blowing pressure in the remaining relay nozzle groups in a progressive manner opposite to the direction of weft yarn travel in a manner as in the adjustment of the blowing pressure of said last relay nozzle group.

5. A method as set forth in claim 4 which further comprises the steps of decreasing the duration of blowing time of the last relay nozzle group after a predetermined number of picks until a per step statistical shows a significant increase in said time difference; and increasing the duration of blowing time by a safety factor in response to a significant increase in said time difference over a previous time difference until said increase disappears.

6. A method as set forth in claim 5 which further comprises the step of adjusting the duration of blowing time in the remaining relay nozzle groups in a progressive manner opposite to the direction of weft yarn travel in a manner as in the adjustment of the duration of blowing time of said last relay nozzle group.

7. A method as set forth in claim 2 which further comprises the steps of adjusting the blowing pressures and duration of blowing times of the relay nozzle groups in a number of passes to obtain a fine adjustment thereof.

8. A method as set forth in claim 2 which further comprises the steps of reducing the blowing pressure of all relay nozzle groups simultaneously a predetermined amount in response to said time difference until a statistical evaluation shows a significant increase in said time difference;

thereafter increasing the blowing pressure of all relay nozzles groups simultaneously by a safety factor in response to a significant increase in said time difference signal over a previous time difference signal until said increase disappears.

9. A method as set forth in claim 2 which further comprises the step of checking the limit for a permissible pressure decrease stepwise after a predetermined number of picks to obtain a continuous optimization of the blowing pressure of the relay nozzle groups.

10. A method as set forth in claim 2 wherein the number of measurements of the time difference signal stored for evaluation is between 20 and 2000.

11. A method as set forth in claim 2 wherein said evaluation steps include forming a statistical quality criterion for weft stretching and for controlling the relay nozzle groups in a stepwise manner over a predetermined number of picks, said criterion containing the average time difference value and the standard deviation of said time differences; and comparing the criterion with criterion values of prior evaluation steps to form said characteristic parameters for controlling the relay nozzle groups.

12. A method as set forth in claim 11 wherein said quality criterion is adaptable by amplification factors and operators in the form $$a[S(\Delta t_1)^{\alpha}+{}^{\beta\alpha}\overline{\Delta\tau_1}^{\cdot}\beta$$

in which:

$\underline{\Delta}t_1$ denotes said time difference between the time of arrival at the first weft stop motion and the instant of response of the second stop motion;

$\overline{\underline{\Delta}t_1}$ denotes the average of $\Delta t_1$ over a predetermined number of picks;

S denotes the standard deviation of $\Delta t_1$;

a, b denote amplification factors, and $\alpha$, $\beta$ denote an exponent or a general mathematical operator.

13. A method as set forth in claim 12 wherein said quality criterion is expanded by a term containing the time difference between the actual arrival at the first weft stop motion and A set-value at the first weft stop motion in the form $$a[S(\Delta t_1)]^{\alpha}+b(\overline{\underline{\Delta}t_1})\beta-c(\overline{\underline{\Delta}t_2})\gamma$$

wherein:

$\underline{\Delta}t_2$ denotes the actual time of arrival less the set value time of arrival;

$\overline{\underline{\Delta}t_2}$ denotes the average of $\Delta t_2$ over the same step as for $\Delta t_1$;

c denotes the amplification factor; and $\gamma$ denotes an exponent or general mathematical operator.

14. A method of controlling an air jet loom including at least one main blowing nozzle for picking a weft yarn into a shed of warp yarns and a plurality of groups of relay nozzles disposed across the shed; said method comprising the steps of detecting the arrival of a picked weft yarn at a shed-end weft stop motion and emitting a first signal in response thereto;

detecting a stop shock in the picked weft yarn in a shed-entry weft stop motion and emitting a second signal in response thereto; and measuring the time difference between said signals to obtain a parameter for controlling at least one of the blowing pressure and the blowing time of at least said groups of relay nozzles.

15. A method as set forth in claim 14 which further comprises the steps of decreasing at least one of the blowing pressure and blowing time for at least the last group of relay nozzles from a predetermined safe zone of pressure and time in a stepwise manner until a predetermined increase is obtained in a measured time difference; and thereafter increasing said one of the blowing pressure and blowing time in step wise manner until said predetermined increase in a measured time difference disappears.

16. In an air jet loom, the combination comprising a main blowing nozzle for picking a weft yarn into a shed of warp yarns;

a plurality of groups of relay nozzles disposed across said shed for blowing a weft yarn along in said shed;

a shed-end stop motion for detecting the arrival of a picked weft yarn at the end of said shed and emitting a first signal in response thereto;

a shed-entry stop motion for detecting a stop shock in a weft yarn and emitting a second signal in response thereto;

at least one pressure valve for controlling the blowing pressure of said relay nozzles;

a plurality of timing valves, each said timing valve being connected with a respective group of relay nozzles for controlling the blowing time of said respective group of relay nozzles; and a loom control system connected to each said stop motion to receive said first and second signals therefrom and to said valves for controlling the subsequent operation of said valves in dependence on a time difference in said signals for a given number of picks.

17. The combination as set forth in claim 16 wherein said pressure valve is connected in common to each group of relay nozzles.

18. The combination as set forth in claim 16 which comprises a plurality of pressure valve, each pressure valve being connected to a respective group of relay nozzles.

19. The combination as set forth in claim 16 wherein said loom control system includes a controller group connected to said valves to produce a travelling zone in said groups of relay nozzles and a computer for evaluating said signals, said computer being connected to said controller to program the operation of said valves.

20. The combination as set forth in claim 19 wherein said computer operates semi-automatically by proposing new set values for said valves after a series of picks with subsequent re-adjustments made manually or automatically on manual confirmation.

* * * * *

UNITED STATES PATENT AND TRADEMARK OFFICE

CERTIFICATE OF CORRECTION

PATENT NO. : 5,067,527

DATED : November 26, 1991

INVENTOR(S) : Godert De Japer

It is certified that error appears in the above-identified patent and that said Letters Patent is hereby corrected as shown below:

On the Title page, item [57]

ABSTRACT, line 1, change "method for" to --method is provided for--.

Title page, [57] ABSTRACT, line 17, change "deflection found" to --deflection is found--.

Column 3, line 31, change "afore" to --previously--.

Column 3, line 38, change "to this" to --to in this--.

Column 3, line 26, change "yarn" to --yarns--.

Column 4, line 4, change "shock" to --shock,--.

Column 5, line 32, "preferable" to --preferbly--.

Column 7, line 1, change "adjustment" to --adjustment--.

UNITED STATES PATENT AND TRADEMARK OFFICE

CERTIFICATE OF CORRECTION

PATENT NO. : 5,067,527

DATED : November 26, 1991

INVENTOR(S) : Godert De Japer

It is certified that error appears in the above-identified patent and that said Letters Patent is hereby corrected as shown below:

Column 7, line 31, change "advantage" to --advantages--.

Column 7, line 31, 32, change "Other advantage are" to --Another advantage is--.

Column 7, line 44, change "$\Delta$" to --$\bar{\Delta}$--.

Column 7, line 25, change "]$\alpha$" to --]"--.

Column 8, line 57, change "statistical" to --statistical evaluation--.

Column 9, line 40, change "$\Delta$" to --$\bar{\Delta}$--.

UNITED STATES PATENT AND TRADEMARK OFFICE

CERTIFICATE OF CORRECTION

PATENT NO. : 5,067,527

DATED : November 26, 1991

INVENTOR(S) : Godert De Japer

It is certified that error appears in the above-identified patent and that said Letters Patent is hereby corrected as shown below:

Column 9, line 40, change "$)^{*}$" to --$)]^{*}$--.

Column 9, line 40, change "$\beta=\Delta_{t_1}\beta$" to --$b(\Delta t_1)\beta$--.

Column 9, line 45, change "$\Delta$" to --$\underline{\Delta}$--.

Column 9, line 47, change "$\Delta$" to --$\underline{\Delta}$--.

Column 9, line 57, change "$\Delta$" to --$\underline{\Delta}$--.

Column 9, line 62, change "$\Delta$" to --$\underline{\Delta}$--.

Column 9, line 63, change "$\Delta$" to --$\underline{\Delta}$--.

Column 9, line 57, change "$(\Delta t_2)\gamma$ to --$(\underline{\Delta}\bar{t}_2)\gamma$ Column 10, line 54, change"valve" to --valves--.

Signed and Sealed this

Twenty-eighth Day of September, 1993

*Attest:*

*Attesting Officer*

Bruce Lehman

BRUCE LEHMAN

*Commissioner of Patents and Trademarks*